US005829162A

United States Patent [19]

Pace

[11] Patent Number: 5,829,162

[45] Date of Patent: Nov. 3, 1998

[54] PORTABLE CLOTHES DRYER

[76] Inventor: David Pace, 27507 Parkview Blvd., Apt. 1204, Warren, Mich. 48092

[21] Appl. No.: 839,958

[22] Filed: Apr. 24, 1997

[51] Int. Cl.[6] ..... F26B 19/00

[52] U.S. Cl. ..... 34/202; 34/622

[58] Field of Search ..... 34/202, 619, 621, 34/622

[56] References Cited

U.S. PATENT DOCUMENTS

| | | | |
|---|---|---|---|
| 3,264,755 | 8/1966 | Moore | 34/622 |
| 3,577,650 | 5/1971 | Brahm | 34/622 |
| 3,905,125 | 9/1975 | Hubner | 34/622 |
| 4,572,364 | 2/1986 | Jordan | 34/622 X |
| 5,642,572 | 7/1997 | Manning | 34/622 X |

FOREIGN PATENT DOCUMENTS

| | | | |
|---|---|---|---|
| 1238937 | 7/1960 | France | 34/622 |
| 2853016 | 6/1979 | Germany | 34/622 |

*Primary Examiner*—Christopher B. Kilner

[57] ABSTRACT

A new Portable Clothes Dryer for providing a system for drying an article of clothing by use of a portable hair dryer. The inventive device includes a bag defining an interior volume adapted for enclosing an article of clothing and an intake port providing communication with the interior volume of the bag. The intake port is adapted for receiving and retaining the outlet nozzle of a portable hair dryer whereby air is discharged out the outlet nozzle of the portable hair dryer, through the intake port, and throughout the bag so as to dry the article of clothing placed therein.

14 Claims, 3 Drawing Sheets

PORTABLE CLOTHES DRYER

BACKGROUND OF THE INVENTION

1. Field of the Invention

The present invention relates to clothes dryers and more particularly pertains to a new Portable Clothes Dryer for providing a system for drying an article of clothing by use of a portable hair dryer.

2. Description of the Prior Art

The use of clothes dryers is known in the prior art. More specifically, clothes dryers heretofore devised and utilized are known to consist basically of familiar, expected and obvious structural configurations, notwithstanding the myriad of designs encompassed by the crowded prior art which have been developed for the fulfillment of countless objectives and requirements.

Known prior art clothes dryers include U.S. Pat. No. 4,873,773; U.S. Pat. No. 5,388,344; U.S. Pat. No. D312,899; U.S. Pat. No. 5,014,446; U.S. Pat. No. 4,918,290; and U.S. Pat. No. 4,819,812.

While these devices fulfill their respective, particular objectives and requirements, the aforementioned patents do not disclose a new Portable Clothes Dryer. The inventive device includes a bag defining an interior volume adapted for enclosing an article of clothing and an intake port providing communication with the interior volume of the bag. The intake port is adapted for receiving and retaining the outlet nozzle of a portable hair dryer whereby air is discharged out the outlet nozzle of the portable hair dryer, through the intake port, and throughout the bag so as to dry the article of clothing placed therein.

In these respects, the Portable Clothes Dryer according to the present invention substantially departs from the conventional concepts and designs of the prior art, and in so doing provides an apparatus primarily developed for the purpose of providing a system for drying an article of clothing by use of a portable hair dryer.

SUMMARY OF THE INVENTION

In view of the foregoing disadvantages inherent in the known types of clothes dryers now present in the prior art, the present invention provides a new Portable Clothes Dryer construction wherein the same can be utilized for providing a system for drying an article of clothing by use of a portable hair dryer.

The general purpose of the present invention, which will be described subsequently in greater detail, is to provide a new Portable Clothes Dryer apparatus and method which has many of the advantages of the clothes dryers mentioned heretofore and many novel features that result in a new Portable Clothes Dryer which is not anticipated, rendered obvious, suggested, or even implied by any of the prior art clothes dryers, either alone or in any combination thereof.

To attain this, the present invention generally comprises a bag defining an interior volume adapted for enclosing an article of clothing and an intake port providing communication with the interior volume of the bag. The intake port is adapted for receiving and retaining the outlet nozzle of a portable hair dryer whereby air is discharged out the outlet nozzle of the portable hair dryer, through the intake port, and throughout the bag so as to dry the article of clothing placed therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Portable Clothes Dryer apparatus and method which has many of the advantages of the clothes dryers mentioned heretofore and many novel features that result in a new Portable Clothes Dryer which is not anticipated, rendered obvious, suggested, or even implied by any of the prior art clothes dryers, either alone or in any combination thereof.

It is another object of the present invention to provide a new Portable Clothes Dryer which may be easily and efficiently manufactured and marketed.

It is a further object of the present invention to provide a new Portable Clothes Dryer which is of a durable and reliable construction.

An even further object of the present invention is to provide a new Portable Clothes Dryer which is susceptible of a low cost of manufacture with regard to both materials and labor, and which accordingly is then susceptible of low prices of sale to the consuming public, thereby making such Portable Clothes Dryer economically available to the buying public.

Still yet another object of the present invention is to provide a new Portable Clothes Dryer which provides in the apparatuses and methods of the prior art some of the advantages thereof, while simultaneously overcoming some of the disadvantages normally associated therewith.

Still another object of the present invention is to provide a new Portable Clothes Dryer for providing a system for drying an article of clothing by use of a portable hair dryer.

Yet another object of the present invention is to provide a new Portable Clothes Dryer which includes a bag defining an interior volume adapted for enclosing an article of clothing and an intake port providing communication with the interior volume of the bag. The intake port is adapted for receiving and retaining the outlet nozzle of a portable hair dryer whereby air is discharged out the outlet nozzle of the portable hair dryer, through the intake port, and throughout the bag so as to dry the article of clothing placed therein.

Still yet another object of the present invention is to provide a new Portable Clothes Dryer that would provide a quick and simple way to dry clothes while traveling.

Even still another object of the present invention is to provide a new Portable Clothes Dryer that can be easily stored and transported in a suitcase while traveling.

Even still another object of the present invention is to provide a new Portable Clothes Dryer that can be used in place of a standard clothes dryer, especially by a person who does not have a standard clothes dryer in their home.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
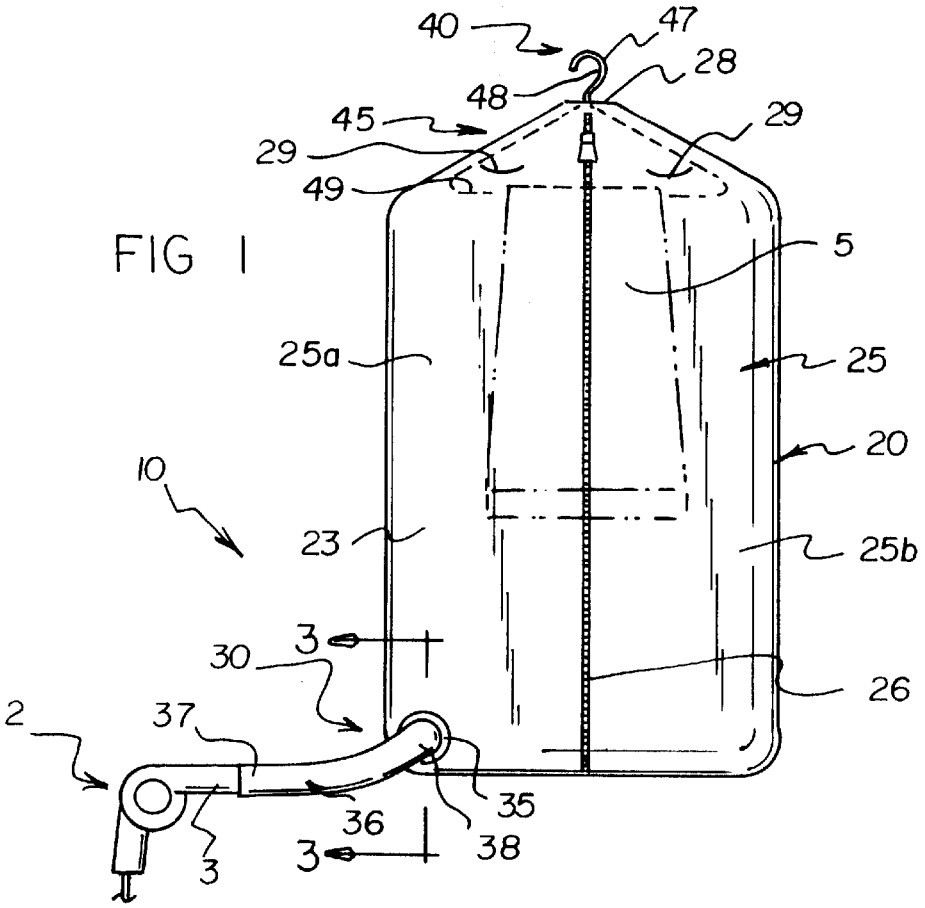
FIG. 1 is an illustration of a new Portable Clothes Dryer according to the present invention.
Figure 2:
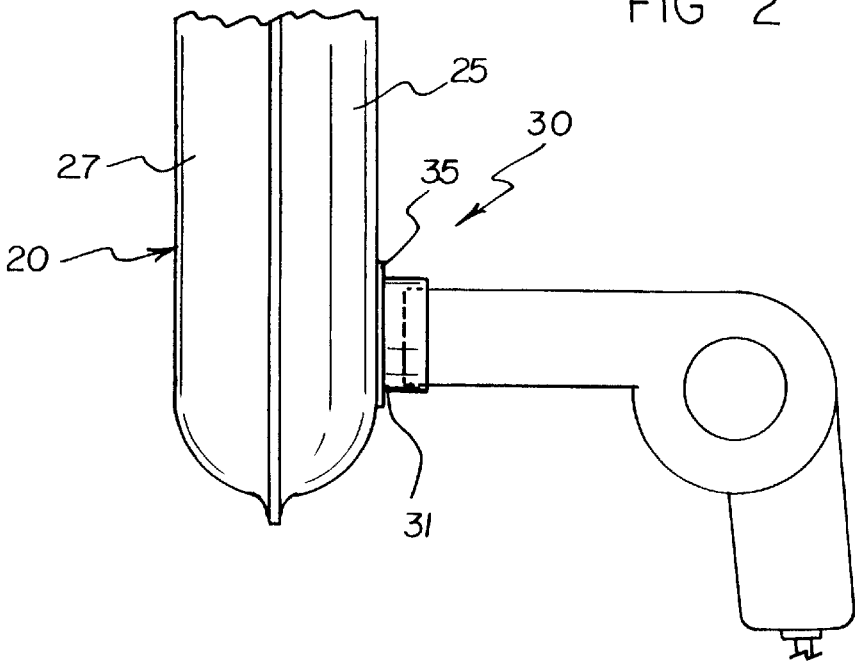
FIG. 2 is an illustration of a portable hair dryer directly coupled with the intake port of the present invention.
Figure 3:
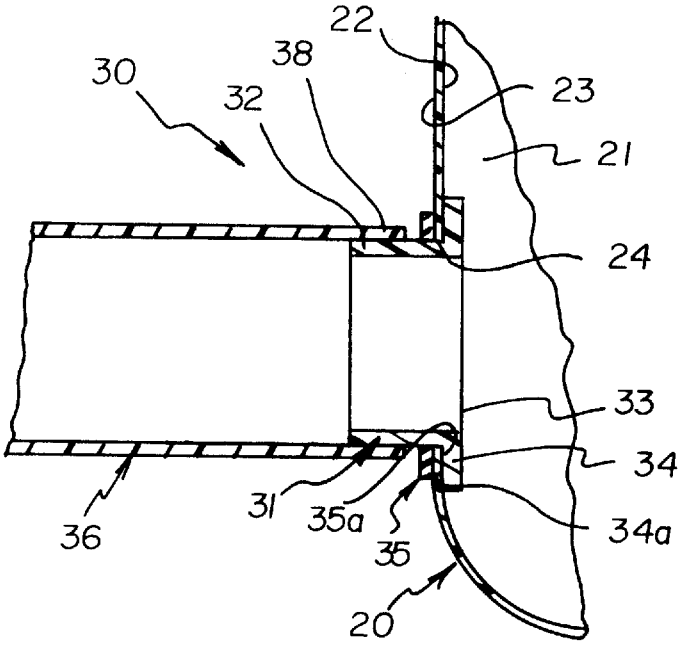
FIG. 3 is a cross sectional view taken along line 3—3 of FIG. 1.
Figure 4:
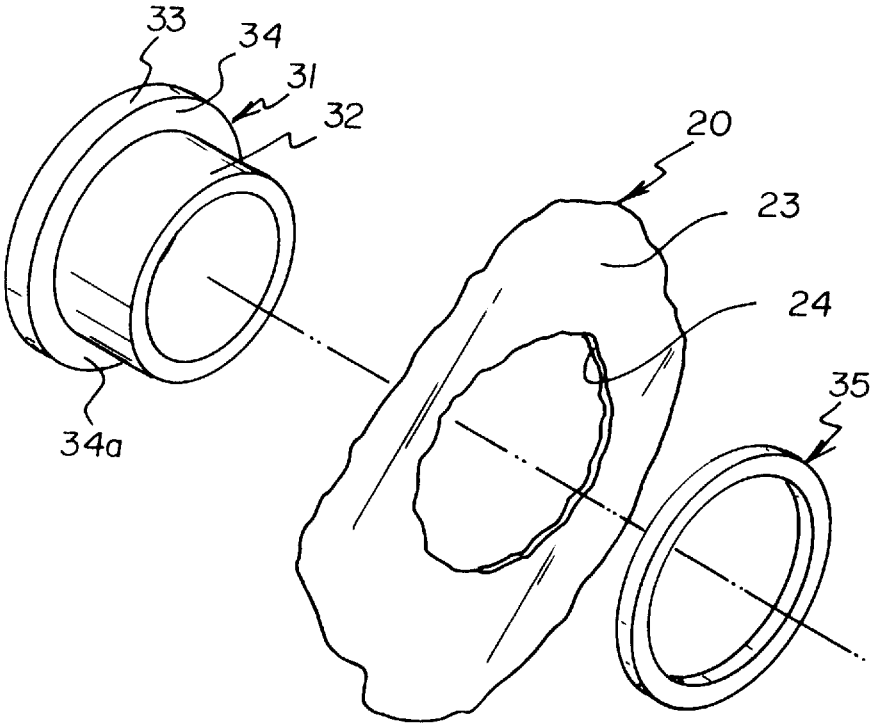
FIG. 4 is an exploded illustration of the intake port of the present invention.

With reference now to the drawings, and in particular to FIGS. 1 through 6 thereof, a new Portable Clothes Dryer embodying the principles and concepts of the present invention and generally designated by the reference numeral 10 will be described.

More specifically, it will be noted that the Portable Clothes Dryer 10 comprises a bag 20 defining an interior volume 21 adapted for enclosing an article of clothing 5 and an intake port 30 providing communication with the interior volume 21 of the bag 20. The intake port 30 is adapted for receiving and retaining the outlet nozzle 3 of a portable hair dryer 2 whereby air is discharged out the outlet nozzle 3 of the portable hair dryer 2, through the intake port 30, and throughout the bag 20 so as to dry the article of clothing 5 placed therein.

The present invention is intended for use in drying an article of clothing 5 with a portable hair dryer 2 wherein the portable hair dryer 2 includes an outlet nozzle 3 out of which warm air passes. Furthermore, the bag 20 may be a garment bag of the kind commonly used to carry and protect suits, dresses, and coats while traveling. It is to be understood that more than one article of clothing 5 may be dried at a time by use of the present invention.

As best illustrated in FIGS. 1 through 4, it can be shown that the bag 20 has an inner surface 22 and an outer surface 23 and has a port hole 24 therein. The bag 20 comprises a front panel 25 and a rear panel 27 joined along mating perimetrical edges thereof so as to define an interior volume 21. The front panel 25 is split and includes a first-half panel 25*a* and a second-half panel 25*b*. A zipper structure 26 releasably joins the first-half panel 25*a* and the second-half panel 25*b*. The zipper structure 26 provides for opening and closing of the bag 20 so as to allow for insertion and removal of the article of clothing 5 into and from the interior volume 21 of the bag 20. The bag 20 is formed of a substantially flexible material such that the bag 20 is easily folded into a convenient storageable form.

In a preferred embodiment, the bag includes a top opening 28. Additionally, a slit 29 may be provided in the front panel 25 or the rear panel 27 of the bag 20. The zipper structure 26, the top opening 28, and the slit 29, individually and collectively, define an outflow means providing for limited outflow of air from the bag 20. As such, air discharged into the bag 20 causes the front panel 25 and the rear panel 27 to expand outwardly. Accordingly, air is forced to circulate throughout the entire interior volume 21 of the bag 20.

A bag hanging means 40 is provided for hanging the bag 20 and a clothing hanging means 45 is provided for hanging the article of clothing 5 within the interior volume 21 of the bag 20. In a preferred embodiment, the bag hanging means 40 comprises a hook portion 48 of a hanger 47 and the clothing hanging means 45 comprises a frame portion 49 of the hanger 47. As such, the hook portion 48 of the hanger 47 extends through the top opening 28 in the bag 20 and the frame portion 49 of the hanger 47 is disposed within the interior volume 21 of the bag 20. Accordingly, the article of clothing 5 may be hung from the frame portion 49 of the hanger 47. In an optional embodiment, the bag hanging means 40 comprises a hook (not shown) coupled to the bag 20 and the clothing hanging means 45 comprises a hanger (not shown) disposed completely within the interior volume 21 of the bag 20.

The intake port 30 comprises a bag fitting 31 fitted within the port hole 24 of the bag 20 and a retaining member 35 coupled to the bag fitting 31 for mounting and retaining the bag fitting 31 within the port hole 24 of the bag 20. The bag fitting 31 is adapted for receiving and retaining the outlet nozzle 3 of the portable hair dryer 2.

The bag fitting 31 has an inlet end 32 and an outlet end 33 and includes a flange 34 at the outlet end 33. The flange 34 has a shoulder surface 34*a*. The bag fitting 31 is inserted through the port hole 24 of the bag 20 such that the shoulder surface 34*a* abuts the inner surface 22 of the bag 20. Accordingly, the inlet end 32 of the bag fitting 31 protrudes from the bag 20 and the outlet end 33 is disposed within the interior volume 21 of the bag 20. As such, the bag fitting 31 provides communication with the interior volume 21 of the bag 20.

The retaining member 35 has a concealed face surface 35*a* and has an inner diameter sufficient for frictional sliding engagement with the bag fitting 31. As such, the retaining member 35 is frictionally slid over the inlet end 32 of the bag fitting 31 such that the concealed face surface 35*a* abuts the outer surface 23 of the bag 20 whereby the bag 20 is interposed between the flange 34 of the bag fitting 31 and the retaining member 35.

Accordingly, the inlet end 32 of the bag fitting 31 is adapted for receiving and retaining the outlet nozzle 3 of the portable hair dryer 2. In a first embodiment, the inlet end 32 of the bag fitting 31 is substantially rigid and sized for frictional engagement with the outlet nozzle 3 of the portable hair dryer 2.

Figure 5:
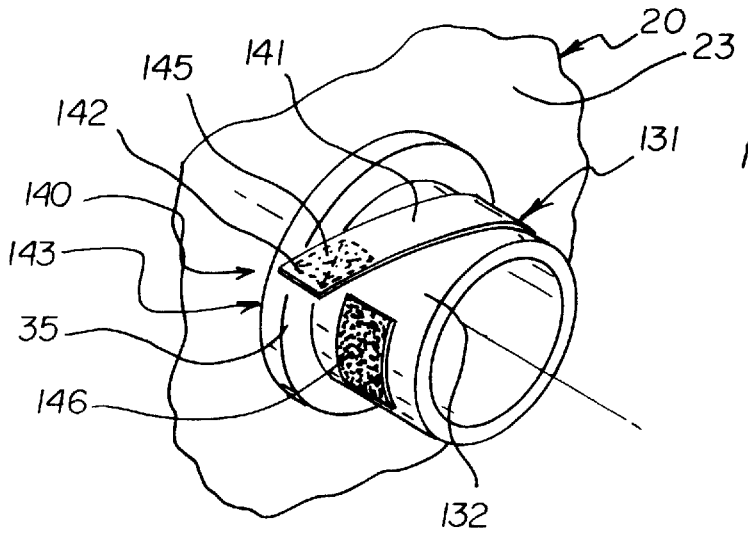
FIG. 5 is an illustration of the adjustable intake port of the present invention.

In a second embodiment, illustrated in FIG. 5, a bag fitting 131 including an adjustable inlet end 132 is provided. As such, the inlet end 132 of the bag fitting 131 is generally flexible. A cincturing means 140 is provided for drawing the inlet end 132 around the outlet nozzle 3 of the portable hair dryer 2.

In a preferred embodiment, the cincturing means 140 comprises a strap 141 secured to and encircling a portion of the inlet end 132. The strap 141 has a free end 142 for grasping thereof and for drawing the inlet end 132 of the bag fitting 131 around the outlet nozzle 3 of the portable hair dryer 2. A releasable fastener 143 secures the free end 142 of the strap 141 to the inlet end 132. The releasable fastener 143 comprises a hook and loop fastener 144 including a hook portion 145 provided on the free end 142 of the strap 141 and a loop portion 146 provided on the inlet end 132 of the bag fitting 131. The cincturing means 140 may also comprise an adjustable encircling band (not shown), similar to that of a conventional hose clamp or wire tie.

An attachment tube 50, illustrated in FIG. 1, may be provided for coupling the outlet nozzle 3 of the portable hair dryer 2 to the intake port 30. The attachment tube 50 has a tube inlet end 51 and a tube outlet end 52. The tube outlet end 52 is joined to the inlet end 32 of the bag fitting 31 and the tube inlet end 51 is adapted for receiving and retaining the outlet nozzle 3 of the portable hair dryer 2. Accordingly, the attachment tube 50 is detachably coupled to the intake port 30 and the outlet nozzle 3 of the portable hair dryer 2 is detachably coupled to the attachment tube 50.

Figure 6:
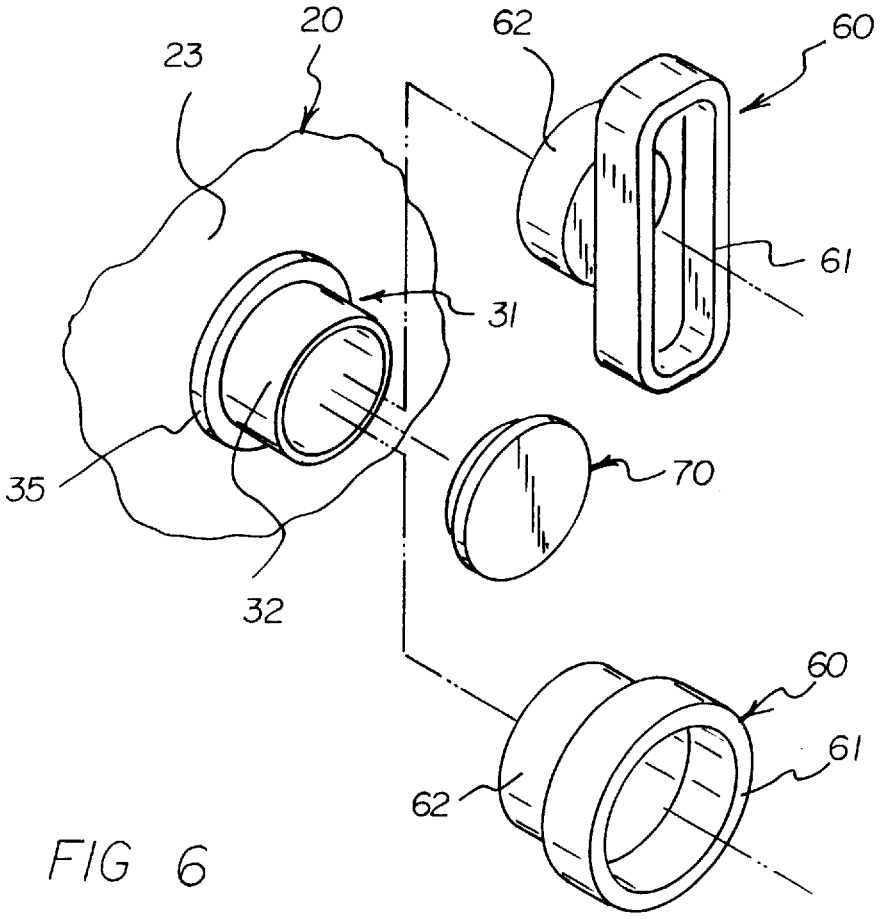
FIG. 6 is an illustration of the attachments for use with the intake port of the present invention.

Furthermore, an attachment fitting 60, illustrated in FIG. 6, may be provided for coupling the outlet nozzle 3 of the portable hair dryer 2 to the intake port 30. The attachment fitting 60 has a fitting inlet end 61 and a fitting outlet end 62. The fitting outlet end 62 is joined to the inlet end 32 of the bag fitting 31 and the fitting inlet end 61 is adapted for receiving and retaining the outlet nozzle 3 of the portable hair dryer 2. Accordingly, the fitting outlet end 62 is sized for mating with the inlet end 32 of the bag fitting 31. Furthermore, the fitting inlet end 61 is sized and configured so as to accommodate an outlet nozzle of a particular portable hair dryer 2. Accordingly, the attachment fitting 60 is detachably coupled to the intake port 30 and the outlet nozzle 3 of the portable hair dryer 2 is detachably coupled to the attachment fitting 60.

In addition, an intake port cap 70, also illustrated in FIG. 6, is provided for closing the intake port 30. Accordingly, the intake port cap 70 fits over the inlet end 32 of the bag fitting 31.

In use, the article of clothing 5 is positioned within the interior volume 21 of the bag 20. Thereafter, the outlet nozzle 3 of the portable hair dryer 2 is matingly fitted with the inlet end 32 of the bag fitting 31. Optionally, the outlet nozzle 3 of the portable hair dryer 2 may be communicably coupled with the inlet end 32 of the bag fitting 31 via the attachment tube 50 or the attachment fitting 60. As such, the tube outlet end 52 of the attachment tube 50 is joined to the inlet end 32 of the bag fitting 31 and the outlet nozzle 3 of the portable hair dryer 2 is coupled to the tube inlet end 51 of the attachment tube 50. Alternatively, the fitting outlet end 62 of the attachment fitting 60 is joined to the inlet end 32 of the bag fitting 31 and the outlet nozzle 3 of the portable hair dryer 2 is coupled to the fitting inlet end 61 of the attachment fitting 60.

The portable hair dryer 2 is activated so as to discharge warm air out the outlet nozzle 3, through the intake port 30, throughout the interior volume 21 of the bag 20, and out of the zipper structure 26, the top opening 28, and the slit 29. Accordingly, the portable hair dryer 2 is activated until the article of clothing 5 is substantially dry. Thereafter, the article of clothing 5 is removed from the interior volume 21 of the bag 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable clothes dryer for use in drying an article of clothing with a portable hair dryer including an outlet nozzle, said portable clothes dryer comprising:

a bag having an interior volume, said bag adapted for enclosing said article of clothing, said bag including an outflow means for allowing limited outflow of air therefrom;

wherein said bag includes a front panel, a rear panel, said front panel and said rear panel joined together along mating perimetrical edges thereof so as to define said interior volume, said front panel including a first-half panel and a second-half panel, and a zipper structure releasably joining said first-half panel and said second-half panel;

wherein said bag has an inner surface and an outer surface and has a port hole therein, said port hole positioned proximate a lower corner of said bag;

an intake port coupled with said bag, said intake port being inserted through said port hole;

said intake port providing communication with said interior volume of said bag and being adapted for receiving said outlet nozzle of said portable hair dryer whereby air discharged out of said outlet nozzle of said portable hair dryer is diverted through said intake port, throughout said bag, and out said outflow means so as to dry said article of clothing placed therein, and a clothing hanging means adapted for hanging the article of clothing within said interior volume of said bag.

2. The portable clothes dryer of claim 1, wherein said bag has at least one of a top opening and a slit therein.

3. The Portable Clothes Dryer of claim 2, wherein said outflow means comprises at least one of said top opening in said bag, said zipper structure, and said slit in said bag.

4. The portable clothes dryer of claim 1, wherein said intake port comprises:

a bag fitting fitted within said port hole of said bag, said bag fitting adapted for receiving said outlet nozzle of said portable hair dryer, and a zipper structure releasably joining said first-half panel and said second-half panel, a retaining member coupled to said bag fitting, said retaining member mounting and retaining said bag fitting within said port hole of said bag.

5. The portable clothes dryer of claim 4, wherein said bag fitting has an inlet end and an outlet end and includes a flange at said outlet end, said flange having a shoulder surface, said bag fitting inserted through said port hole of said bag and providing communication with said interior volume of said bag, said shoulder surface of said flange abutting said inner surface of said bag, said inlet end of said bag fitting protruding from said bag and said outlet end of said bag fitting being disposed within said interior volume of said bag, said inlet end adapted for receiving said outlet nozzle of said portable hair dryer.

6. The portable clothes dryer of claim 5, wherein said retaining member fits over said inlet end of said bag fitting, and wherein said retaining member has a concealed face surface, said concealed face surface abutting said outer surface of said bag whereby a portion of said bag adjacent said port hole is interposed between said retaining member and said flange of said bag fitting.

7. The portable clothes dryer of claim 5, further comprising:

a cincturing means for drawing said inlet end of said bag fitting around said outlet nozzle of said portable hair dryer.

8. The portable clothes dryer of claim 7, wherein said cincturing means comprises:

a strap secured to and encircling a portion of said inlet end, said strap having a free end, and a releasable fastener securing said free end of said strap to said inlet end.

9. The portable clothes dryer of claim 8, wherein said releasable fastener comprises:

a hook and loop fastener including one of a hook and loop portion provided on said free end of said strap and the other of the hook and loop portion provided on said inlet end of said bag fitting.

10. The portable clothes dryer of claim 7, wherein said cincturing means comprises:

an adjustable encircling band.

11. The portable clothes dryer of claim 1, further comprising:

a bag hanging means for hanging said bag.

12. The portable clothes dryer of claim 11, wherein said bag hanging means comprises a hook portion of a hanger and said clothing hanging means comprises a frame portion of said hanger, said hook portion of said hanger extending beyond said bag and said frame portion of said hanger being positioned within said interior volume of said bag.

13. The portable clothes dryer of claim 4, further comprising at least one of:

an attachment tube, one end of said attachment tube coupled with said bag fitting, another end of said attachment tube adapted for receiving said outlet nozzle of said portable hair dryer, and an attachment fitting, one end of said attachment fitting coupled with said bag fitting, another end of said attachment fitting adapted for receiving said outlet nozzle of said portable hair dryer.

14. A portable clothes dryer for use in drying an article of clothing with a portable hair dryer including an outlet nozzle, said portable clothes dryer comprising:

a bag having an interior volume, said bag adapted for enclosing said article of clothing, said bag including an outflow means for allowing limited outflow of air therefrom;

wherein said bag includes a front panel, a rear panel, said front panel and said rear panel joined together along mating perimetrical edges thereof so as to define said interior volume, said front panel including a first-half panel and a second-half panel, and a zipper structure releasably joining said first-half panel and said second-half panel;

wherein said bag further has at least one of a top opening and a slit therein;

wherein said outflow means comprises at least one of said top opening in said bag, said zipper structure, and said slit in said bag;

wherein said bag has an inner surface and an outer surface and has a port hole therein, said port hole positioned proximate a lower corner of said bag;

an intake port coupled with said bag, said intake port being inserted through said port hole;

said intake port including a bag fitting within said port hole of said bag, said bag fitting adapted for receiving said outlet nozzle of said portable hair dryer, said intake port further including a retaining member coupled to said bag fitting, said retaining member mounting and retaining said bag fitting within said port hole of said bag;

wherein said bag fitting has an inlet end and an outlet end and includes a flange at said outlet end, said flange having a shoulder surface;

said bag fitting inserted through said port hole of said bag and providing communication with said interior volume of said bag, said shoulder surface of said flange abutting said inner surface of said bag;

said inlet end of said bag fitting protruding from said bag and said outlet end of said bag fitting being disposed within said interior volume of said bag, said inlet end adapted for receiving said outlet nozzle of said portable hair dryer;

wherein said bag fitting has an inlet end and an outlet end and includes a flange at said outlet end, said flange having a shoulder surface;

said bag fitting inserted through said port hole of said bag and providing communication with said interior volume of said bag, said shoulder surface of said flange abutting said inner surface of said bag;

said inlet end of said bag fitting protruding from said bag and said outlet end of said bag fitting being disposed within said interior volume of said bag, said inlet end adapted for receiving said outlet nozzle of said portable hair dryer;

a clothing hanging means adapted for hanging the article of clothing within said interior volume of said bag;

a bag hanging means for hanging said bag;

wherein said bag hanging means includes a hook portion of a hanger and said clothing hanging means includes a frame portion of said hanger, said hook portion of said hanger extending beyond said bag and said frame portion of said hanger being positioned within said interior volume of said bag;

an attachment tube, one end of said attachment tube coupled with said bag fitting, another end of said attachment tube adapted for receiving said outlet nozzle of said portable hair dryer; and said intake port providing communication with said interior volume of said bag and being adapted for receiving said outlet nozzle of said portable hair dryer whereby air discharged out of said outlet nozzle of said portable hair dryer is diverted through said intake port, throughout said bag, and out said outflow means so as to dry said article of clothing placed therein.

* * * * *